US008525052B2

(12) United States Patent
Gentsch

(10) Patent No.: US 8,525,052 B2
(45) Date of Patent: Sep. 3, 2013

(54) SWITCH ARRANGEMENT FOR MEDIUM AND HIGH-VOLTAGE SWITCHING DEVICES

(75) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/164,286

(22) Filed: Jun. 20, 2011

(65) Prior Publication Data

US 2012/0152702 A1 Jun. 21, 2012

Related U.S. Application Data

(63) Continuation of application No. PCT/EP2009/008927, filed on Dec. 14, 2009.

(30) Foreign Application Priority Data

Dec. 18, 2008 (EP) ..... 08021978

(51) Int. Cl.
*H01H 27/10* (2006.01)

(52) U.S. Cl.
USPC ..... 200/42.01

(58) Field of Classification Search
USPC ..... 200/42.01, 5 R, 52 R, 239; 218/82, 218/154
See application file for complete search history.

(56) References Cited

U.S. PATENT DOCUMENTS

| | | | | |
|---|---|---|---|---|
| 3,532,843 A | | 10/1970 | Pucher | |
| 3,796,888 A | * | 3/1974 | Berry | 180/270 |
| 4,182,940 A | * | 1/1980 | Scussel et al. | 200/19.39 |
| 4,436,065 A | * | 3/1984 | Gradmann | 123/179.3 |
| 4,570,078 A | * | 2/1986 | Yashima et al. | 307/10.1 |
| 6,657,150 B1 | | 12/2003 | Shea et al. | |
| 2009/0120773 A1 | | 5/2009 | Gentsch et al. | |

FOREIGN PATENT DOCUMENTS

| | | |
|---|---|---|
| DE | 1 094 864 B | 12/1960 |
| DE | 11 41 015 B | 12/1962 |
| DE | 26 23 816 A1 | 12/1977 |
| DE | 31 48 142 A1 | 6/1983 |
| DE | 295 03 914 U1 | 7/1996 |
| DE | 197 46 809 A1 | 4/1999 |
| DE | 102 54 497 B3 | 6/2004 |
| DE | 10 2006 024 991 A1 | 12/2007 |
| FR | 1 535 272 A | 8/1968 |
| WO | WO 96/19186 A1 | 6/1996 |
| WO | WO 96/19816 A1 | 6/1996 |

OTHER PUBLICATIONS

Form PCT/ISA/210 (International Search Report) dated Aug. 14, 2007.
German Office Action dated Jun. 7, 2006.

(Continued)

*Primary Examiner* — Edwin A. Leon
(74) *Attorney, Agent, or Firm* — Buchanan Ingersoll & Rooney PC

(57) ABSTRACT

The disclosure relates to a switch arrangement for medium and high-voltage switching devices having switches, with which at least one of the contacts is a moving contact which can be actuated by an ignition charge. For a plurality of switches, a dedicated ignition device is provided for each switch, and the ignition devices are coupled together with regard to the time of the ignition.

16 Claims, 2 Drawing Sheets

(56) References Cited

OTHER PUBLICATIONS

International Preliminary Report on Patentability (Form PCT/IB/373), written Opinion of the International Search Authority (Form PCT/ISA/237) mailed in corresponding International Patent Application No. PCT/EP2007/004671, Jan. 13, 2009, The International Bureau of WIPO, Geneva, CH.

International Search Report (PCT/ISA/210) issued on Mar. 25, 2010, by Japanese Patent Office as the International Searching Authority for International Application No. PCT/EP2009/008927.

* cited by examiner

SWITCH ARRANGEMENT FOR MEDIUM AND HIGH-VOLTAGE SWITCHING DEVICES

RELATED APPLICATION

This application claims priority as a continuation application under 35 U.S.C. §120 to PCT/EP2009/008927, which was filed as an International Application on Dec. 14, 2009 designating the U.S., and which claims priority to European Application 08021978.5 filed in Europe on Dec. 18, 2008. The entire contents of these applications are hereby incorporated by reference in their entireties.

FIELD

The disclosure relates to a switch arrangement for switching devices having switches for example, medium and high-voltage switching devices, in which at least one of the contacts is a moving contact which can be actuated by an ignition charge.

BACKGROUND INFORMATION

A short-circuit device is disclosed in DE 102 54 497 B3 in which a propelling charge is provided for moving the moving contact. Although a fast contact closure can be achieved in this way, a switch device in high-voltage and high-current applications must be considered separately.

SUMMARY

A switch arrangement is disclosed for voltage switching devices comprising: a plurality of switches, each switch including a moving contact for activation by an ignition charge and a contact that is a fixed contact; a dedicated ignition device for each switch; and a coupling for igniting the ignition devices for each switch substantially at a same time.

A method is disclosed for operation of voltage switching devices including switches, each switch including at least one contact that is a moving contact which can be activated by an ignition charge, the method comprising providing a dedicated ignition device for each switch and coupling the ignition device together to ignite at substantially a same time.

BRIEF DESCRIPTION OF THE DRAWINGS

Exemplary embodiments of the disclosure are described in the following text with reference to the drawings which only serve for explanation and are not to be construed as being limiting. In the drawings.

DETAILED DESCRIPTION

Figure 1:
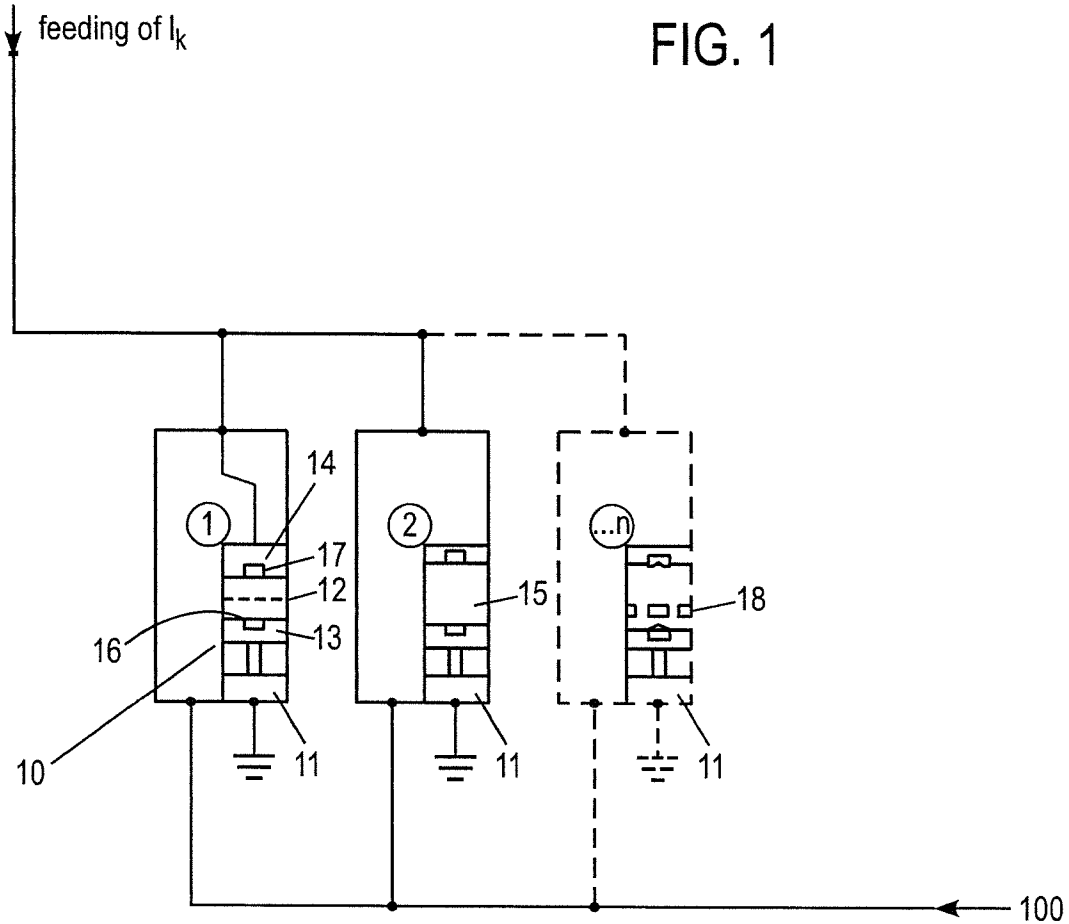
FIG. 1 shows an exemplary embodiment of a switch arrangement for a high-current switching device.

The disclosure relates to a switch arrangement for a high-current arrangement and a high-voltage arrangement.

According to the disclosure, for a plurality of switches a dedicated ignition device can be provided for each switch, and the ignition devices can be coupled together with regard to the time of the ignition. This can achieve synchronous (i.e., substantially synchronous) ignition of the ignition devices.

Accordingly there can be at least two alternative arrangements. A first arrangement relates to a short-circuit device arrangement in high-current design.

A second arrangement relates to a short-circuit device arrangement in high-voltage design.

With regard to the first arrangement, two or more independent switches can be connected in parallel, and a propelling charge for each switch can be applied by a common ignition device. This can make it possible to achieve substantially synchronous short-circuiting, resulting in an effective current carrying capacity due to the parallel circuit.

With regard to the second arrangement, two or more independent switches can be connected in series, and the propelling charge of a first switch can be directly electrically ignited, while the propelling charge or the electrical ignition of a second or following switch can be galvanically isolated from the first. This series circuit can result in an effective dielectric strength. However, with the series circuit, increases can occur in the potential of the respective propelling charges due to marginally different ignition times.

In order to avoid this, the propelling charges or primers can be galvanically isolated from one another. In an exemplary embodiment the propelling charge of the second switch can be ignited by a photoelectric device. The photo section provides galvanic isolation.

In an exemplary embodiment, each moving contact 16 can be connected to a piston-cylinder unit 10 in which one or more propelling charges 11 can be arranged. A gas-tight membrane 12 is provided between the piston 13 and the contact piece 14. The membrane can be punctured by the piston at intended breakpoints when the propelling charge is ignited.

In an exemplary embodiment, at least the chambers in which the switching path lies can be vacuum chambers 15.

Furthermore, a plurality of metallic screen elements 18, which are each separated from one another by a gap, can be provided around each moving contact 16 along the switching path.

In an exemplary embodiment, the moving contacts can be designed with a conical shape and the respective fixed contacts 17 can be provided with an inner cone in a complementary manner.

FIG. 1 shows an exemplary embodiment including a plurality of parallel connected short-circuit devices 1, 2, . . . , 5. Each of these short-circuit devices has a moving contact 16 and a fixed contact 17. The parallel connection in its entirety results in the high-current version, or the version with a high effective current carrying capacity. Here, the respective moving contact 16 is in each case driven by a propelling charge 11. The propelling charges 11 of all parallel connected short-circuit devices can be controlled substantially synchronously in time by a common ignition device 100.

Figure 2:
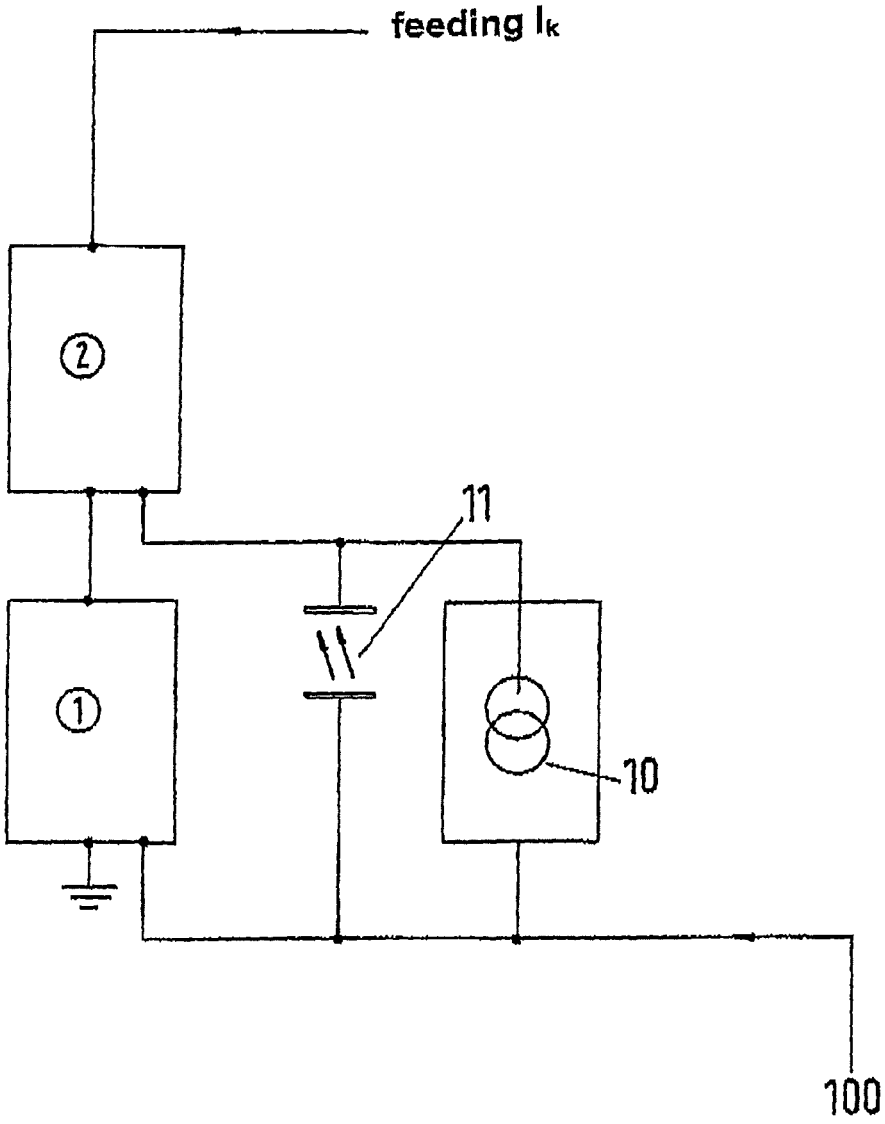
FIG. 2 shows an exemplary embodiment of a switch arrangement for a high-voltage switching device.

FIG. 2 shows an exemplary embodiment of a series circuit of short-circuit devices. This results in the high-voltage version. In this version, the voltage can be divided. Although a common ignition device can also be provided here in order to achieve potential isolation, only one of the short-circuit devices, i.e. the primer/propelling charge of one of the short-circuit devices, can be controlled directly, while the control of the primer/propelling charge of the second short-circuit device must be potentially isolated. This can be achieved by interposing either a pulse transformer or a photoelectric section in the ignition line.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCES

1, . . . , 5 Short-circuit device
10 Potential isolator/Pulse transformer
11 Photoelectric section
100 Ignition device

What is claimed is:

1. A switch arrangement for voltage switching devices, comprising:

a plurality of switches, each switch including a moving contact for activation by a propellant charge and a contact that is a fixed contact;

a dedicated electrical ignition device for the propellant charge of each switch; and a coupling for igniting the propellant charge for each switch substantially at a same time, wherein the plurality of switches are connected in series, and the propellant charge of a first switch being directly electrically ignited, wherein the electrical ignition device of a second or following switch is galvanically isolated from the first switch.

2. The switch arrangement as claimed in claim 1, comprising:

a photoelectric device for igniting the propellant charge of the second switch.

3. The switch arrangement as claimed in claim 1, comprising:

a piston-cylinder unit including one or more propellant charges each having a moving contact connected to a respective piston-cylinder unit.

4. The switch arrangement as claimed in claim 3, comprising:

a gas-tight membrane, which is punctured by the piston at intended breakpoints when the propellant charge is ignited, provided between the piston and the moving contact.

5. The switch arrangement as claimed in claim 1, comprising:

vacuum chambers in a switching path.

6. The switch arrangement as claimed in claim 1, comprising:

a plurality of metallic screen elements, which are each separated from one another by a gap, provided around each moving contact along a switching path.

7. The switch arrangement as claimed in claim 1, wherein the moving contacts are designed with a conical shape and respective fixed contacts are provided with an inner cone in a complementary manner.

8. The switch arrangement as claimed in claim 2, comprising:

a piston-cylindrical unit including one or more propellant charges, each comprising moving contact connected to a respective piston-cylinder unit.

9. The switch arrangement as claimed in claim 8, comprising:

a gas-tight membrane, which is punctured by the piston at intended breakpoints when the propellant charge is ignited, is provided between piston and contact piece.

10. The switch arrangement as claimed in claim 2, comprising:

vacuum chambers in a switching path.

11. The switch arrangement as claimed in claim 2, comprising:

a plurality of metallic screen elements, which are each separated from one another by a gap, provided around each moving contact along a switching path.

12. The switch arrangement as claimed in claim 2, wherein the moving contacts are designed with a conical shape and respective fixed contacts are provided with an inner cone in a complementary manner.

13. The switch arranged according to claim 1, wherein the switching device is a medium or high voltage switching device.

14. A method for operation of voltage switching devices including a plurality of switches, each switch including a moving contact which can be activated by a propellant charge and a contact that is a fixed contact, the method comprising:

providing a dedicated electrical ignition device for the propellant charge of each switch;

coupling the ignition devices together to perform ignition of the propellant charge of each switch at substantially a same time;

connecting the plurality of switches in series;

arranging the propellant charge of a first switch to be directly electrically ignited; and galvanically isolating the electrical ignition device of a second or following switch from the first switch.

15. The method of operation as claimed in claim 14, comprising:

igniting the propellant charge of the second switch by a photoelectric device.

16. The method of operation as claimed in claim 14, comprising:

connecting a piston-cylinder unit in which one or more propellant charges are arranged to the moving contact.

* * * * *